United States Patent [19]

Smith

[11] 3,995,401

[45] Dec. 7, 1976

[54] METHOD OF ATTACHING WALLBOARD AND STUD THEREFOR

[75] Inventor: Richard E. Smith, Williamsville, N.Y.

[73] Assignee: National Gypsum Company, Buffalo, N.Y.

[22] Filed: Nov. 20, 1975

[21] Appl. No.: 633,666

[52] U.S. Cl. ..... 52/127; 52/746; 156/71

[51] Int. Cl.[2] ..... E04B 1/00

[58] Field of Search ..... 52/127, 746, 474, 384, 52/390, 416; 156/71

[56] References Cited

FOREIGN PATENTS OR APPLICATIONS 1,306,225 2/1973 United Kingdom ..... 156/71

*Primary Examiner*—J. Karl Bell

*Attorney, Agent, or Firm*—Robert F. Hause

[57] ABSTRACT

Wall framing members, specially fabricated with grooves in one face, have wallboard affixed to the framing member face by a specially fabricated compatible injector for forcing hot melt adhesive into the groove, while the wallboard is being held firmly against the framing member face.

8 Claims, 6 Drawing Figures

METHOD OF ATTACHING WALLBOARD AND STUD THEREFOR

This invention relates to wallboard attachment to wall framing members, and particularly to the attachment of predecorated wallboard which must be affixed by means which do not damage the predecorated face of the board.

A number of methods have been proposed heretofore for attaching wallboard to studs and joists without damaging the wallboard front face as it is damaged by the common nailing or screwing method generally employed in drywall construction. These prior methods have met with varying degrees of success. Some have advantages in some types of construction, others have advantages in other forms of construction.

The present invention is particularly advantageous for use in relatively low cost factory-made housing, wherein relatively high speed is needed in each step of the process. Briefly, the invention contemplates preparing studs or joists to receive a controlled amount of hot melt adhesive from an injector, and to direct the hot melt adhesive instantly to a location between the stud or joist and the abutting wallboard whereat it will immediately cool and provide an instantaneous bond of the board to the stud or joist.

It is an object of the invention to provide a method of affixing wallboard to framing members by an instantaneous injection of hot melt adhesive to preplanned areas therebetween.

It is a further object of the invention to provide novel wall framing members for receiving and directing hot melt adhesive during mounting of wallboard.

It is a still further object of the invention to provide a combination of wall framing member and hot melt injector which coact to place hot melt adhesive in a desired location between framing member and wallboard.

These and other objects and advantages will appear more fully when considered in connection with the following detailed description of preferred embodiments of the invention and the accompanying drawings in which.

Figure 1:
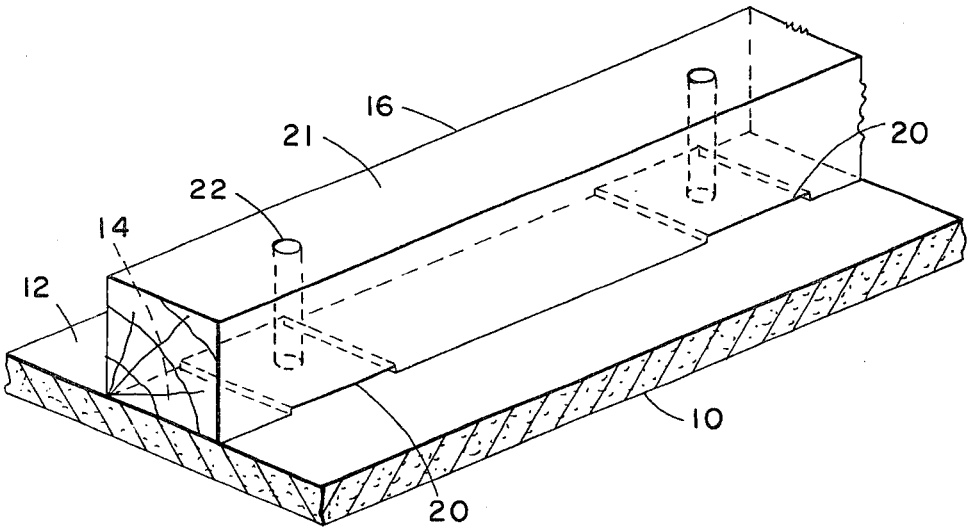
FIG. 1 is an isometric view of a 2 inch × 2 inch wood framing member prepared for affixation to an adjacent wallboard, in accordance with the invention.

Referring to FIG. 1, there is shown a wallboard 10 disposed with its back surface 12 against the face 14 of a 2 inch × 2 inch wood stud 16. As shown, the wallboard is not affixed to stud 16. Stud 16 is specially formed, in accordance with the invention, to be rapidly and firmly adhered to the back surface 12 with hot melt adhesive.

Stud 16 has a plurality of depressions or grooves 20, cut into the otherwise completely flat face 14. Grooves 20 have a depth which is determined, by experimentation, to permit a hot melt adhesive, to be used therewith, to flow rapidly to all areas of the groove, with the use of a minimum amount of hot melt adhesive. Extending from the center of each groove 20 to the opposite face 21 of stud 16 is an elongate cylindrical hole 22. Hole 22 is provided as a means for injecting hot melt adhesive into each groove 20. In a preferred form, hole 22 is of ⅜ inch (1 cm) diameter, and groove 20 is 1½ inches (3.8 cm) wide and about 1/32 to 1/16 inch (0.1 to 0.2 cm) deep.

Figure 2:
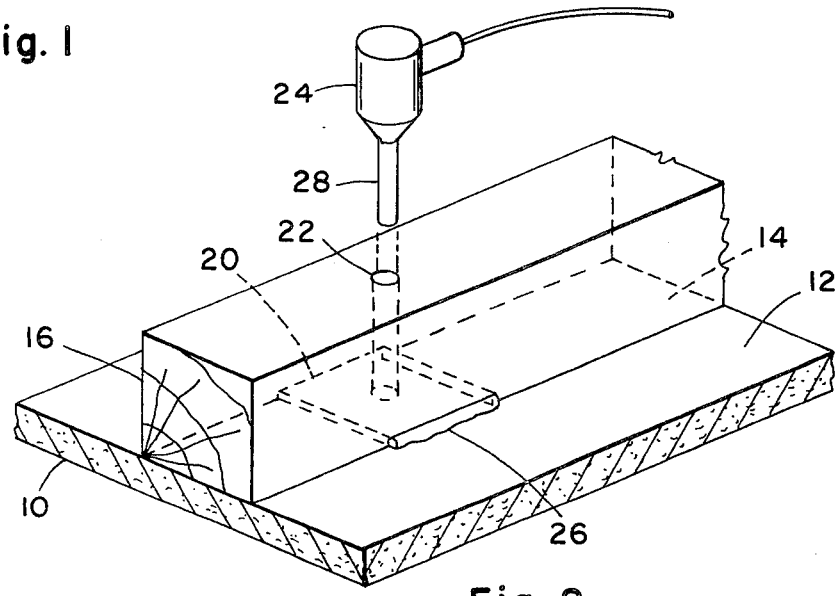
FIG. 2 is an isometric view of the framing member and wallboard of FIG. 1 after affixation of the two with hot melt adhesive, showing the hot melt injector adjacent the framing member.

Referring to FIG. 2, there is shown a hot melt adhesive injector 24 which has been withdrawn from hole 22 after having injected hot melt adhesive 26 into the full extent of groove 20, with a slight amount of the adhesive 26 projecting out from the end of groove 20. Injector 24 is formed with a special nozzle 28 having a diameter and length substantially equal to the diameter and length of hole 22.

The injector 24, including the nozzle 28, are heated to melt a supply of hot melt adhesive therein. The injector has means for forcing the melted hot melt adhesive out through the nozzle 28. The form of the nozzle 28 prevents the hot melt adhesive from flowing back into the hole 22, and causes the hot melt adhesive to flow instead into the full extent of the groove 20. When an operator sees the hot melt adhesive starting to protrude from the end of the groove 20, the injection of the hot melt adhesive is stopped. The hot melt adhesive 26 starts to cool and solidify and acquire adhesive properties immediately after being inserted into the groove.

It will be apparent that means will need be provided to maintain the wallboard 10 tightly against the stud 16 during injection of the hot melt adhesive, and this can be done in several ways. A second workman can be holding board while the hot melt injector operator is injecting hot melt adhesive. The wallboard can be placed on the floor or on a table top while studs are affixed to the back of the board. Studs and boards can be affixed together in a suitable jig during insertion of the hot melt adhesive.

Figure 3:
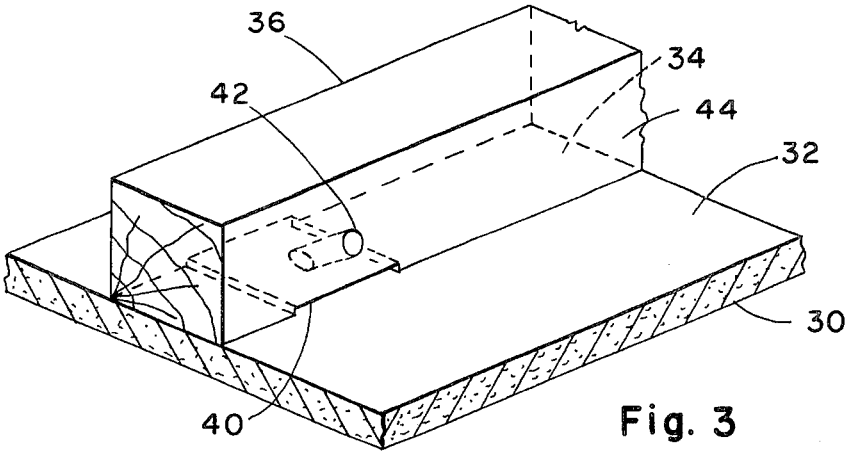
FIG. 3 is an isometric view similar to FIG. 1, with modified form of framing member.

In FIG. 3, wallboard 30 has a back surface 32 against the face 34 of stud 36. Stud 36 has a plurality of grooves 40 in face 34, each adjacent an elongate cylindrical hole 42, extending from the center of groove 40 angularly to a side 44 of the stud. Hot melt adhesive can be injected through holes 42 to fill the space formed by grooves 40 and the abutting wallboard 30.

Figure 4:
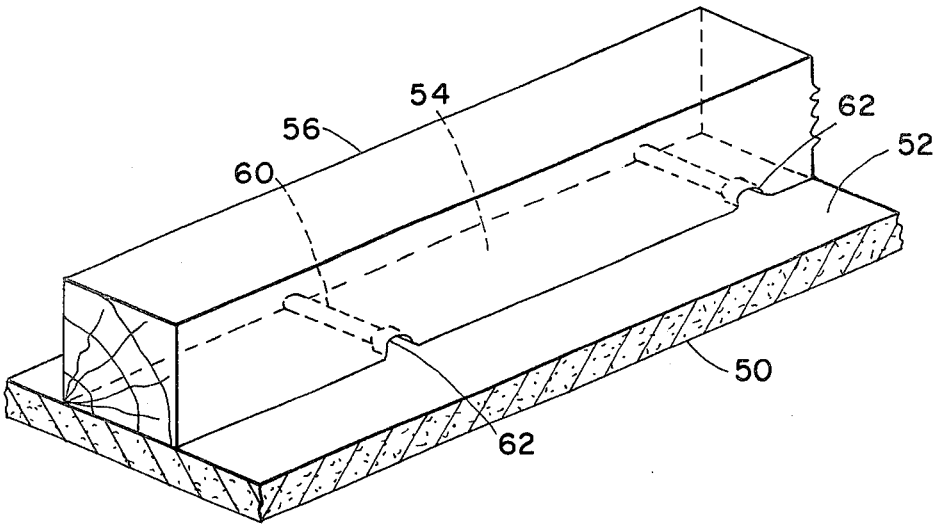
FIG. 4 is an isometric view similar to FIG. 1 showing a further modified form of framing member.

The wallboard 50 in FIG. 4 has a back surface 52 disposed against the face 54 of stud 56. Stud 56 has a plurality of grooves 60 in stud face 54. At least one end of each groove 60 has a special inlet form 62 adapted to receive and surround a nozzle on a hot melt adhesive injector, such as the nozzle 28 in FIG. 2.

Figure 5:
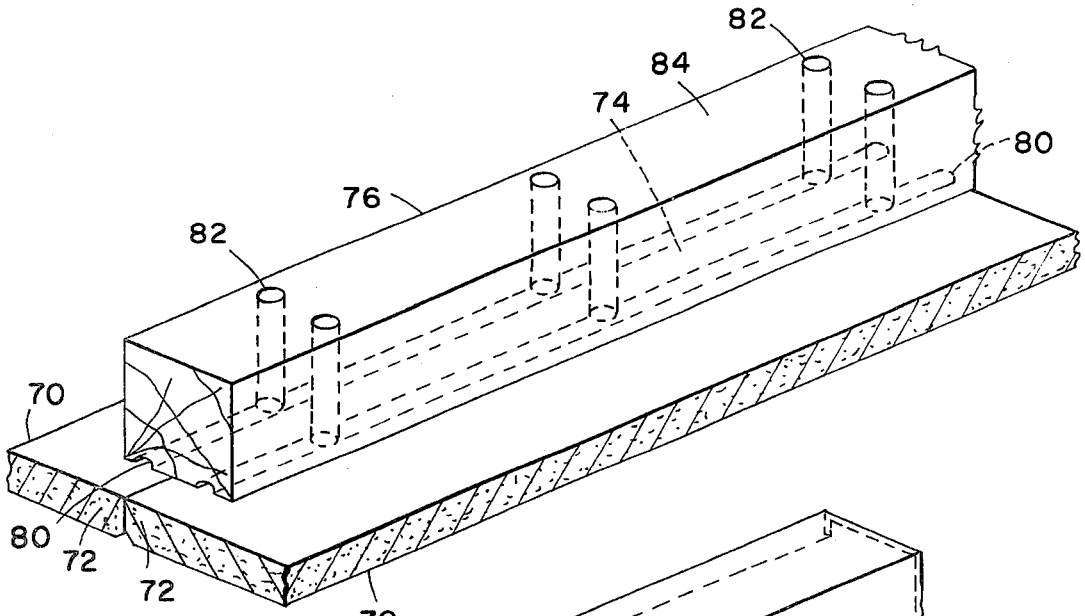
FIG. 5 is an isometric view similar to FIG. 1 showing a modified form of framing member located at a joint between two abutting wallboards.

In FIG. 5, a pair of adjacent wallboards 70, 70 are shown with an edge portion 72 of each disposed over a half of the face 74 of stud 76. Stud 76 has a pair of grooves 80, 80 extending in spaced parallel relation along the length of stud face 74, with one wallboard edge 72 over one groove 80, and the other wallboard edge 72 over the other groove 80. A plurality of elongate cylindrical holes 82 extend from the grooves 80 to the opposite face 84, for insertion of molten hot melt adhesive into grooves 80.

Figure 6:
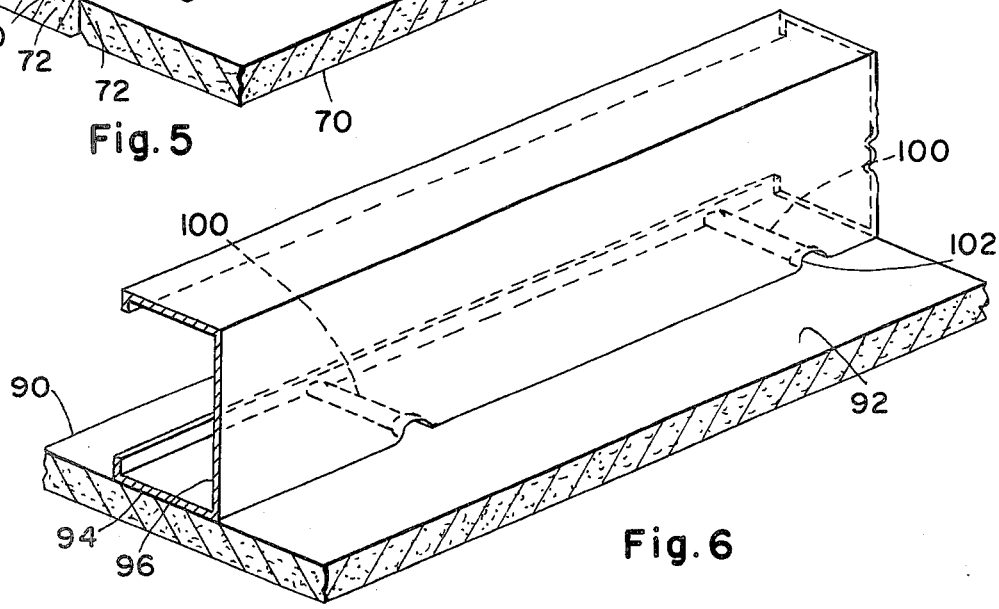
FIG. 6 is an isometric view similar to FIG. 1, showing a metal stud, in accordance with the invention.

FIG. 6 shows a wallboard 90 with a back surface 92 adjacent the face 94 of a metal stud 96. Stud 96 has grooves 100 formed in face 94 with formed ends 102 on grooves 100 adapted for the reception of a hot melt adhesive injector nozzle of complementary form.

Having completed a detailed disclosure of the preferred embodiments of my invention so that those skilled in the art may practice the same, I contemplate that variations may be made without departing from the essence of the invention or the scope of the appended claims.

I claim:

1. An elongate framing member for instantaneous reception of molten hot melt adhesive at a face thereof, said framing member comprising a body with one elongate narrow face thereon for affixation to wallboard, a shallow depression in said face of said framing member, said depression having a size adapted for filling rapidly with a relatively minimum thickness of a molten hot melt adhesive, and an exposed inlet for injecting molten hot melt adhesive therethrough into said depression when said face is covered with a flat surface of a wallboard.

2. The framing member of claim 1 wherein said inlet is an elongate hole extending from said depression to a remote surface of said framing member.

3. The framing member of claim 1 wherein said depression has a depth substantially throughout of from about 1/32 inch to about 1/16 inch.

4. The combination of an elongate framing member as defined in claim 1 and a wallboard affixed thereto with a hot melt adhesive, said adhesive being disposed within and substantially throughout said depression, said wallboard being held against the face of said framing member by said adhesive in said depression.

5. The combination of an elongate framing member as defined in claim 1 and an injector for hot melt adhesive, said injector having a nozzle for insertion into said exposed inlet in said framing member, said nozzle having an external form complementary to the shape of said inlet, whereby molten adhesive is prevented from flwowing between said nozzle and said inlet.

6. The method of affixing wallboard to a framing member comprising the steps of disposing a wallboard back surface against the face of a framing member having a shallow groove in said face, forcing molten hot melt adhesive into said groove and substantially throughout the extent of said groove, and maintaining said wallboard back surface firmly against the face of said framing member during said forcing of adhesive and during a period thereafter during which said adhesive cools.

7. The method of claim 6 wherein said framing member has an elongate hole extending from said groove to a remote surface of said framing member and wherein said molten adhesive is forced to said groove through said elongate hole.

8. The method of claim 7 wherein said molten adhesive is forced through said elongate hole from an injector nozzle which is inserted into said hole and which substantially fills said hole by reason of the nozzle complementary configuration.

* * * * *